US006372703B1

(12) United States Patent
Richter et al.

(10) Patent No.: US 6,372,703 B1
(45) Date of Patent: Apr. 16, 2002

(54) NON-AQUEOUS BLEACH-CONTAINING LIQUID DETERGENTS

(75) Inventors: Bernd Richter, Leichlingen; Ulrich Pegelow, Duesseldorf, both of (DE)

(73) Assignee: Henkel Komanditgesellschaft auf Aktien, Duesseldorf (DE)

( * ) Notice: Subject to any disclaimer, the term of this patent is extended or adjusted under 35 U.S.C. 154(b) by 0 days.

(21) Appl. No.: 09/354,392

(22) Filed: Jul. 15, 1999

(30) Foreign Application Priority Data

Jul. 15, 1998 (DE) ..... 198 31 702

(51) Int. Cl.[7] ..... C11D 3/395; C11D 1/62; C11D 1/86

(52) U.S. Cl. ..... 510/367; 510/276; 510/283; 510/285; 510/286; 510/289; 510/290; 510/304; 510/302; 510/308; 510/309; 510/329; 510/338; 510/356; 510/371; 510/407; 510/421; 510/504; 510/509

(58) Field of Search ..... 510/276, 283, 510/285, 286, 289, 304, 290, 302, 308, 309, 329, 338, 356, 367, 371, 407, 421, 504, 509

(56) References Cited

U.S. PATENT DOCUMENTS

| | | | | |
|---|---|---|---|---|
| 4,664,839 A | | 5/1987 | Rieck | 252/175 |
| 5,780,420 A | | 7/1998 | Breuer et al. | 510/466 |
| 5,853,430 A | * | 12/1998 | Shindo et al. | 8/137 |

FOREIGN PATENT DOCUMENTS

| | | |
|---|---|---|
| DE | 44 00 024 | 7/1995 |
| DE | 196 16 570 | 10/1997 |
| EP | 0 164 514 | 12/1985 |
| EP | 0 340 989 | 11/1989 |
| EP | 0 344 909 | 12/1989 |
| JP | 58 217598 | 12/1983 |
| WO | WO90/13533 | 11/1990 |
| WO | WO91/08171 | 6/1991 |
| WO | WO93/06201 | 4/1993 |
| WO | WO95/07331 | 3/1995 |
| WO | WO96/10072 | 4/1996 |

OTHER PUBLICATIONS

Derwent Patent Abstract (WPAT) No. 97–527736/49.
Derwent Patent Abstract (WPAT) No. 84–026893/05.
Derwent Patent Abstract (WPAT) No. 90–336011/45.
Derwent Patent Abstract (WPAT) No. 85–270605/44.
Derwent Patent Abstract (WPAT) No. 95–247054/33.

* cited by examiner

*Primary Examiner*—Charles Boyer
*Assistant Examiner*—Charles Bo
(74) *Attorney, Agent, or Firm*—Glenn E. J. Murphy

(57) ABSTRACT

A liquid non-aqueous detergent is presented containing a nonionic surfactant, a builder, a bleaching agent, and a cationic stabilizer of formula I, II or III:

(I)

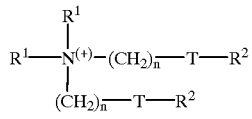

(II)

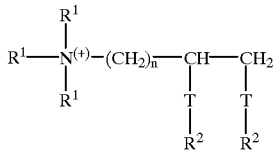

(III)

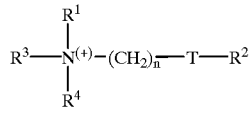

where the groups $R^1$ independently of one another are $C_{1-6}$ alkyl, alkenyl or hydroxyalkyl groups, the groups $R^2$ independently of one another are $C_{8-28}$ alkyl or alkenyl groups, $R^3$ has the same meaning as $R^1$ or represents $(CH_2)_n$—T—$R^2$, $R^4$ has the same meaning as $R^1$ or $R^2$ or represents $(CH_2)_n$—T—$R^2$, T represents —$CH_2$—, —O—CO— or —CO—O— and n is an integer of from 0 to 5. The solid bleaching agents in the stabilized non-aqueous liquid detergent retain their activity after prolonged storage.

19 Claims, No Drawings

NON-AQUEOUS BLEACH-CONTAINING LIQUID DETERGENTS

BACKGROUND OF THE INVENTION

1. Field of the Invention

This invention relates to non-aqueous liquid detergents which contain nonionic surfactant(s), builder(s) and bleaching agent and which show increased stability of the bleaching agent. The present invention also relates to the use of special stabilizers for stabilizing bleaching agents in non-aqueous liquid detergents.

2. Discussion of Related Art

Liquid detergents are enjoying increasing popularity among consumers because they are easier to dose and generally dissolve better and faster. However, these advantages are offset by technical difficulties which have to be overcome in the production and storage of the detergents. Thus, it is almost impossible to incorporate a bleaching system in aqueous detergents because the bleaching agents steadily lose activity as a result of hydrolysis, so that the effectiveness of the detergents in removing bleachable soils is reduced. However, the incorporation of bleaching agents and bleach activators in non-aqueous liquid detergents is also problematical. Thus, even so-called "water-free" detergents still contain small residues of water, which cause the hydrolysis problems mentioned above, or absorb these quantities of water during storage and use. In addition, the decomposition of bleaching agents is catalyzed by the presence of traces of heavy metals which can even be found in the non-aqueous solvents on which the "water-free" detergents are based.

There are several proposed solutions in the prior art for increasing the stability of bleach-containing non-aqueous liquid detergents, these proposed solutions generally involving the use of certain stabilizers. Thus, EP 340 989 (Colgate), for example, describes the use of $C_{5-21}$ fatty acids, fatty acid salts or fatty acid glyceryl monoesters or diesters as stabilizers in non-aqueous liquid detergents containing bleaching agent and bleach activator. The use of vicinal hydroxy compounds for this purpose is disclosed in EP 344 909 (Colgate).

WO 93/06201 (Henkel) describes a non-aqueous liquid or paste-form detergent containing 5 to 20% by weight of hydrated zeolite A, 50 to 80% by weight of anionic and/or nonionic surfactant, 5 to 20% by weight of bleaching agent, up to 6% by weight of bleach activator and up to 6% by weight of a complexing agent for heavy metals.

WO 96/10072 (Procter & Gamble) discloses a process for the production of non-aqueous bleach-containing liquid detergents which show high chemical and physical stability and produce excellent washing and bleaching results, characterized in that fine-particle detergent components are suspended in a non-aqueous liquid matrix of alcohol ethoxylates.

The use of other complexing agents and/or radical scavengers for stabilizing bleaching agents is widely described in the prior art.

However, the effect of the measures described in the prior art for stabilizing bleaching agents in non-aqueous liquid detergents is unsatisfactory. In the event of prolonged storage, the bleaching agents undergo decomposition, despite the use of the stabilizers mentioned, while the detergents lose washing power.

Now, the problem addressed by the present invention was to provide a stable bleach-containing liquid detergent which would contain the solid bleaching agents in the form of a stable dispersion. The bleaching agents would not undergo any loss of activity, even in the event of prolonged storage of the detergent.

The solution to this problem is characterized in that certain cationic compounds are incorporated as stabilizers in the non-aqueous liquid detergents.

DESCRIPTION OF THE INVENTION

Accordingly, the present invention relates to a non-aqueous liquid detergent containing nonionic surfactant(s), builder(s) and bleaching agent, characterized in that it contains as stabilizer one or more cationic compounds corresponding to formula I, II or III:

(I)

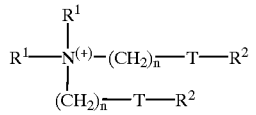

(II)

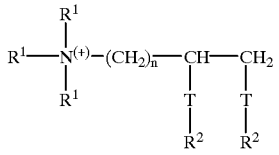

(III)

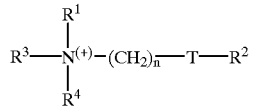

in which the groups $R^1$ independently of one another are each selected from $C_{1-6}$ alkyl, alkenyl or hydroxyalkyl groups, the groups $R^2$ independently of one another are each selected from $C_{8-28}$ alkyl or alkenyl groups, $R^3$ has the same meaning as $R^1$ or represents $(CH_2)_n$—T—$R^2$, $R^4$ has the same meaning as $R^1$ or $R^2$ or represents $(CH_2)_n$—T—$R^2$, T represents —$CH_2$—, —O—CO— or —CO—O— and n is an integer of 0 to 5.

The expression "non-aqueous" in the context of the present invention is understood to apply to detergents which only contain small quantities of free water, i.e. water which is not bound as water of crystallization or in any other way. Since even non-aqueous solvents and raw materials (particularly those of technical quality) have certain water contents, entirely water-free compositions can only be produced with great difficulty and at high cost on an industrial scale. Accordingly, small quantities of free water of less than 5% by weight and preferably less than 2% by weight, based on the final detergent, are tolerable in the "non-aqueous" detergents according to the present invention.

The liquid detergents according to the present invention can be produced within a broad viscosity range. Thus, it is possible to produce not only low viscosity, readily pumpable detergents according to the invention, but also high-viscosity or even paste-like detergents with relatively high viscosities. Paste-form detergents may even have a spreadable or cuttable consistency. Even in detergents such as these, the use of the cationic stabilizers leads to the bleach-stabilizing effects according to the present invention.

The cationic stabilizers may be introduced into the detergents according to the invention in varying quantities. The content of cationic stabilizers corresponding to the above formulae in the detergents according to the invention is normally from 0.5 to 10% by weight, preferably from 1 to 6% by weight and more preferably from 2 to 4% by weight.

Preferred cationic stabilizers are obtained by esterification of triethanolamine with long-chain fatty acids and subsequent quaternization. Both the esterification step and the quaternization step are carried out in known manner, dimethyl sulfate preferably being used as the quaternizing agent. Preferred detergents contain a quaternized triethanolamine ester as cationic stabilizer.

Other preferred cationic stabilizers are compounds which are derived from formula I above and in which the groups $R^1$ independently of one another are each selected from methyl, ethyl and 2-hydroxyethyl groups; the groups $R^2$ independently of one another are each selected from $C_{8-28}$ alkyl or alkenyl groups, preferably from $C_{10-20}$ alkyl or alkenyl groups and more preferably from $C_{12-18}$ alkyl or alkenyl groups, T represents O—CO— and n is the number 1, 2 or 3. Cationic stabilizers such as these are commercially available, for example, under the names of Stepantex® VA 90, Stepantex® VS 90 (trademarks of the Stepan Company) and Dehyquart® AU 46 and Dehyquart® AU 57 (trademarks of Henkel/Pulcra).

The cationic stabilizers to be used in accordance with the invention may be used either on their own or in combination with other stabilizers known from the prior art. The stabilizers described in the prior art can be divided into three large groups, namely: antioxidants, drying agents and complexing agents.

Suitable antioxidants are, for example, phenols, bisphenols and thiobisphenols substituted by sterically hindered groups. Other classes of antioxidants are aromatic amines, preferably secondary aromatic amines, and substituted p-phenylenediamines, phosphorus compounds containing trivalent phosphorus, such as phosphines, phosphites and phosphonites, compounds containing enediol groups, so-called reductones, such as ascorbic acid and derivatives thereof, organic sulfur compounds, such as the esters of 3,3'-thiodipropionic acid with $C_{1-18}$ alkanols, more especially $C_{10-18}$ alkanols, metal ion deactivators which are capable of complexing autoxidation-catalyzing metal ions, for example copper, such as EDTA, nitrilotriacetic acid etc. and mixtures thereof. A large number of examples of such antioxidants can be found in DE 196 16 570 (BASF AG)—the antioxidants mentioned there may readily be used in combination with the cationic stabilizers for the purposes of the present invention.

Drying agents which may be used in combination with cationic stabilizers in accordance with the present invention are, for example, inorganic salts which are capable of hydrate formation and which thus bind free water. Water-free magnesium and sodium sulfate are mentioned as examples. Overdried silicates and aluminium silicates, such as aerogels for example, and overdried zeolites also belong to this class of compounds. Organic drying agents may of course also be used, examples of such drying agents being substances which swell by taking up water, but which do not release the water taken up under the conditions prevailing in the non-aqueous liquid detergent. This class includes, for example, cellulose and starch and derivatives thereof, such as carboxymethyl cellulose and carboxymethyl starch, hydroxypropyl cellulose and hydroxypropyl starch, etc.

The group of complexing agents includes, for example, the alkali metal salts of ethylenediamine tetraacetic acid (EDTA) or nitrilotriacetic acid (NTA) and alkali metal salts of anionic polyelectrolytes, such as polyacrylates, polymaleates and polysulfonates. Low molecular weight hydroxycarboxylic acids, such as citric acid, tartaric acid, malic acid or gluconic acid and salts thereof are also suitable. Suitable complexing agents may also be selected from organophosphonates such as, for example, 1-hydroxyethane-1,1-diphosphonic acid (HEDP), aminotri(methylene phosphonic acid) (ATMP), diethylenetriamine penta(methylenephosphonic acid) and 2-phosphonobutane-1,2,4-tricarboxylic acid (PBS-AM). These complexing agents may be introduced into the detergents according to the invention in quantities of, for example, 0.1 to 5% by weight and preferably in quantities of around 1% by weight.

The detergents according to the invention contain one or more nonionic surfactant(s) as a crucial ingredient. Preferred nonionic surfactants are alkoxylated, advantageously ethoxylated, more especially primary alcohols preferably containing 8 to 18 carbon atoms and, on average, 1 to 12 moles of ethylene oxide (EO) per mole of alcohol, in which the alcohol radical may be linear or, preferably, methyl-branched in the 2-position or may contain linear and methyl-branched radicals in the form of the mixtures typically present in oxoalcohol radicals. However, alcohol ethoxylates containing linear radicals of alcohols of native origin with 12 to 18 carbon atoms, for example coconut oil, palm oil, tallow fatty or oleyl alcohol, and on average 2 to 8 EO per mole of alcohol are particularly preferred. Preferred ethoxylated alcohols include, for example, $C_{12-14}$ alcohols containing 3 EO or 4 EO, $C_{9-11}$ alcohol containing 7 EO, $C_{13-15}$ alcohols containing 3 EO, 5 EO, 7 EO or 8 EO, $C_{12-18}$ alcohols containing 3 EO, 5 EO or 7 EO and mixtures thereof, such as mixtures of $C_{12-14}$ alcohol containing 3 EO and $C_{12-18}$ alcohol containing 5 EO. The degrees of ethoxylation mentioned represent statistical mean values which, for a special product, can be a whole number or a broken number. Preferred alcohol ethoxylates have a narrow homolog distribution (narrow range ethoxylates, NRE). In addition to these nonionic surfactants, fatty alcohols containing more than 12 EO may also be used, examples including tallow fatty alcohol containing 14 EO, 25 EO, 30 EO or 40 EO.

Other nonionic surfactants suitable for use in accordance with the invention are alkyl glycosides corresponding to the general formula $RO(G)_x$, where R is a primary linear or methyl-branched, more especially 2-methyl-branched, aliphatic radical containing 8 to 22 and preferably 12 to 18 carbon atoms and G is a glycose unit containing 5 or 6 carbon atoms, preferably glucose. The degree of oligomerization x, which indicates the distribution of monoglycosides and oligoglycosides, is a number of 1 to 10, preferred values for x being 1.2 to 1.4.

Another class of preferred nonionic surfactants which may be used either as sole nonionic surfactant or in combination with other nonionic surfactants are alkoxylated, preferably ethoxylated or ethoxylated and propoxylated, fatty acid alkyl esters preferably containing 1 to 4 carbon atoms in the alkyl chain, more especially the fatty acid methyl esters which are described, for example, in Japanese patent application JP 58/217598 or which are preferably produced by the process described in International patent application WO-A-90/13533.

Nonionic surfactants of the amine oxide type, for example N-cocoalkyl-N,N-dimethylamine oxide and N-tallow alkyl-N,N-dihydroxyethyl-amine oxide, and the fatty acid alkanolamide type are also suitable. The quantity in which these nonionic surfactants are used is preferably no more than the quantity in which the ethoxylated fatty alcohols are used and, more particularly, no more than half that quantity.

Other suitable surfactants are polyhydroxyfatty acid amides corresponding to formula (IV):

(IV)

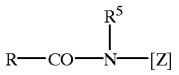

in which RCO is an aliphatic acyl group containing 6 to 22 carbon atoms, $R^5$ is hydrogen, an alkyl or hydroxyalkyl group containing 1 to 4 carbon atoms and [Z] is a linear or branched polyhydroxyalkyl group containing 3 to 10 carbon atoms and 3 to 10 hydroxyl groups. The polyhydroxyfatty acid amides are known substances which may normally be obtained by reductive amination of a reducing sugar with ammonia, an alkylamine or an alkanolamine and subsequent acylation with a fatty acid, a fatty acid alkyl ester or a fatty acid chloride.

The group of polyhydroxyfatty acid amides also includes compounds corresponding to formula (V):

(V)

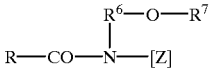

in which R is a linear or branched alkyl or alkenyl group containing 7 to 12 carbon atoms, $R^6$ is a linear, branched or cyclic alkyl group or an aryl group containing 2 to 8 carbon atoms and $R^7$ is a linear, branched or cyclic alkyl group or an aryl group or an oxyalkyl group containing 1 to 8 carbon atoms, $C_{1-4}$ alkyl or phenyl groups being preferred, and [Z] is a linear polyhydroxy-alkyl group, of which the alkyl chain is substituted by at least two hydroxyl groups, or alkoxylated, preferably ethoxylated or propoxylated, derivatives of that group.

[Z] is preferably obtained by reductive amination of a reduced sugar, for example glucose, fructose, maltose, lactose, galactose, mannose or xylose. The N-alkoxy- or N-aryloxy-substituted compounds may then be converted into the required polyhydroxyfatty acid amides by reaction with fatty acid methyl esters in the presence of an alkoxide as catalyst, for example in accordance with the teaching of International patent application WO-A-95/07331.

According to the invention, preferred non-aqueous liquid detergents are those which contain 5 to 70% by weight, preferably 15 to 65% by weight and more preferably 20 to 60% by weight of one or more nonionic surfactants from the group of alkoxylated, preferably ethoxylated or ethoxylated and propoxylated, alcohols and/or carboxylic acids containing 8 to 28, preferably 10 to 20 and more preferably 12 to 18 carbon atoms.

In addition to the nonionic surfactants, the detergents according to the invention may contain anionic surfactants. Suitable anionic surfactants are, for example, those of the sulfonate and sulfate type. Suitable surfactants of the sulfonate type are preferably $C_{9-13}$ alkyl benzenesulfonates, olefin sulfonates, i.e. mixtures of alkene and hydroxy-alkane sulfonates, and the disulfonates obtained, for example, from $C_{12-18}$ monoolefins with an internal or terminal double bond by sulfonation with gaseous sulfur trioxide and subsequent alkaline or acidic hydrolysis of the sulfonation products. Other suitable surfactants of the sulfonate type are the alkane sulfonates obtained from $C_{12-18}$ alkanes, for example by sulfochlorination or sulfoxidation and subsequent hydrolysis or neutralization. The esters of α-sulfofatty acids (ester sulfonates), for example the α-sulfonated methyl esters of hydrogenated coconut oil, palm kernel oil or tallow fatty acids, are also suitable.

Other suitable anionic surfactants are sulfonated fatty acid glycerol esters. Fatty acid glycerol esters in the context of the present invention are the monoesters, diesters and triesters and mixtures thereof which are obtained where production is carried out by esterification of a monoglycerol with 1 to 3 moles of fatty acid or in the transesterification of triglycerides with 0.3 to 2 moles of glycerol. Preferred sulfonated fatty acid glycerol esters are the sulfonation products of saturated fatty acids containing 6 to 22 carbon atoms, for example caproic acid, caprylic acid, capric acid, myristic acid, lauric acid, palmitic acid, stearic acid or behenic acid.

Preferred alk(en)yl sulfates are the alkali metal salts and, in particular, the sodium salts of the sulfuric acid semiesters of $C_{12-18}$ fatty alcohols, for example cocofatty alcohol, tallow fatty alcohol, lauryl, myristyl, cetyl or stearyl alcohol, or $C_{10-20}$ oxoalcohols and the corresponding semiesters of secondary alcohols with the same chain length. Other preferred alk(en)yl sulfates are those with the chain length mentioned which contain a synthetic, linear alkyl chain based on a petrochemical and which are similar in their degradation behavior to the corresponding compounds based on oleochemical raw materials. $C_{12-16}$ alkyl sulfates, $C_{12-15}$ alkyl sulfates and $C_{14-15}$ alkyl sulfates are preferred from the point of view of washing technology. Other suitable anionic surfactants are 2,3-alkyl sulfates which may be produced, for example, in accordance with U.S. Pat. No. 3,234,258 or U.S. Pat. No. 5,075,041 and which are commercially obtainable as products of the Shell Oil Company under the name of DAN®.

The sulfuric acid monoesters of linear or branched $C_{7-21}$ alcohols ethoxylated with 1 to 6 moles of ethylene oxide, such as 2-methyl-branched $C_{9-11}$ alcohols containing on average 3.5 moles of ethylene oxide (EO) or $C_{12-18}$ fatty alcohols containing 1 to 4 EO, are also suitable. In view of their high foaming capacity, they are only used in relatively small quantities, for example in quantifies of 1 to 5% by weight, in detergents.

Other preferred anionic surfactants are the salts of alkyl sulfosuccinic acid which are also known as sulfosuccinates or as sulfosuccinic acid esters and which represent monoesters and/or diesters of sulfosuccinic acid with alcohols, preferably fatty alcohols and, more particularly, ethoxylated fatty alcohols. Preferred sulfosuccinates contain $C_{8-18}$ fatty alcohol residues or mixtures thereof. Particularly preferred sulfosuccinates contain a fatty alcohol residue derived from ethoxylated fatty alcohols which, considered in isolation, represent nonionic surfactants (for a description, see below). Of these sulfosuccinates, those of which the fatty alcohol residues are derived from narrow-range ethoxylated fatty alcohols are particularly preferred. Alk(en)yl succinic acid preferably containing 8 to 18 carbon atoms in the alk(en)yl chain or salts thereof may also be used.

Other suitable anionic surfactants are, in particular, soaps. Suitable soaps are saturated fatty acid soaps, such as the salts of lauric acid, myristic acid, palmitic acid, stearic acid, hydrogenated erucic acid and behenic acid, and soap mixtures derived in particular from natural fatty acids, for example coconut oil, palm kernel oil or tallow fatty acids.

The anionic surfactants, including the soaps, may be present in the form of their sodium, potassium or ammonium salts and as soluble salts of organic bases, such as mono-, di- or triethanolamine. The anionic surfactants are preferably present in the form of their sodium or potassium salts and, more preferably, in the form of their sodium salts.

Preferred liquid detergents additionally contain anionic surfactants, preferably from the group of alkyl sulfates, alkyl sulfonates, alkyl benzenesulfonates and fatty acid soaps.

Besides surfactants and the cationic stabilizer, the non-aqueous liquid detergents according to the invention contain builders. Any of the builders normally used in detergents may be introduced into the press-agglomerated detergents, including in particular zeolites, silicates, carbonates, organic co-builders and also—providing there are no ecological objections to their use—phosphates.

Suitable crystalline layer-form sodium silicates correspond to the general formula $Na_2MSi_xO_{2x+1}$. y $H_2O$, where M is sodium or hydrogen, x is a number of 1.9 to 4 and y is a number of 0 to 20, preferred values for x being 2, 3 or 4. Crystalline layer silicates such as these are described, for example, in European patent application EP-A-0 164 514. Preferred crystalline layer silicates corresponding to the above formula are those in which M is sodium and x assumes the value 2 or 3. Both β- and δ-sodium disilicates $Na_2Si_2O_5$. y $H_2O$ are particularly preferred, β-sodium disilicate being obtainable, for example, by the process described in International patent application WO-A-91/08171.

Other useful builders are amorphous sodium silicates with a modulus ($Na_2O:SiO_2$ ratio) of 1:2 to 1:3.3, preferably 1:2 to 1:2.8 and more preferably 1:2 to 1:2.6 which dissolve with delay and exhibit multiple wash cycle properties. The delay in dissolution in relation to conventional amorphous sodium silicates can have been obtained in various ways, for example by surface treatment, compounding, compacting or by overdrying. In the context of the invention, the term "amorphous" is also understood to encompass "X-ray amorphous". In other words, the silicates do not produce any of the sharp X-ray reflexes typical of crystalline substances in X-ray diffraction experiments, but at best one or more maxima of the scattered X-radiation which have a width of several degrees of the diffraction angle. However, particularly good builder properties may even be achieved where the silicate particles produce crooked or even sharp diffraction maxima in electron diffraction experiments. This may be interpreted to mean that the products have microcrystalline regions between 10 and a few hundred nm in size, values of up to at most 50 nm and, more particularly, up to at most 20 nm being preferred. So-called X-ray amorphous silicates such as these, which also dissolve with delay in relation to conventional waterglasses, are described for example in German patent application DE-A-44 00 024. Compacted amorphous silicates, compounded amorphous silicates and overdried X-ray-amorphous silicates are particularly preferred.

The finely crystalline, synthetic zeolite containing combined water used in accordance with the invention is preferably zeolite A and/or zeolite P. Zeolite MAP® (Crosfield) is a particularly preferred P-type zeolite. However, zeolite X and mixtures of A, X and/or P are also suitable. According to the invention, it is also possible to use, for example, a commercially obtainable co-crystallizate of zeolite X and zeolite A (ca. 80% by weight zeolite X) which is marketed by CONDEA Augusta S.p.A. under the name of VEGOGOND AX® and which may be described by the following formula:

$$nNa_2O\ (1-n)K_2O{\cdot}Al_2O_3{\cdot}(2-2.5)SiO_2{\cdot}(3.5-5.5)\ H_2O$$

Suitable zeolites have a mean particle size of less than 10 μm (volume distribution, as measured by the Coulter Counter Method) and contain preferably 18 to 22% by weight and more preferably 20 to 22% by weight of combined water. The zeolites may also be used as overdried zeolites with relatively low water contents and are then suitable by virtue of their hygroscopicity for removing unwanted residual traces of free water.

The generally known phosphates may of course also be used as builders providing their use should not be avoided on ecological grounds. The sodium salts of the orthophosphates, the pyrophosphates and, in particular, the tripolyphosphates are particularly suitable.

Useful organic builders are, for example, the polycarboxylic acids usable, for example, in the form of their sodium salts, such as citric acid, adipic acid, succinic acid, glutaric acid, tartaric acid, sugar acids, amino-carboxylic acids, nitrilotriacetic acid (NTA), providing their use is not ecologically unsafe, and mixtures thereof. Preferred salts are the salts of the polycarboxylic acids, such as citric acid, adipic acid, succinic acid, glutaric acid, tartaric acid, sugar acids and mixtures thereof, sodium citrate being particularly preferred.

The builder content of the detergents according to the invention is normally from 1 to 30% by weight and preferably from 10 to 25% by weight. Preferred non-aqueous liquid detergents contain water-soluble builders, preferably from the group of oligo- and polycarboxylates, carbonates and crystalline and/or amorphous silicates, as builders. Among these compounds, the salts of citric acid have proved to be particularly suitable, the alkali metal salts being preferred and the sodium salts particularly preferred.

The non-aqueous liquid detergents according to the invention contain one or more bleaching agents. Among the compounds yielding $H_2O_2$ in water which serve as bleaching agents, sodium perborate tetrahydrate and sodium perborate monohydrate are particularly important. Other useful bleaching agents are, for example, sodium percarbonate, peroxypyrophosphates, citrate perhydrates and $H_2O_2$-yielding peracidic salts or peracids, such as perbenzoates, peroxophthalates, diperazelaic acid, phthaloiminoperacid or diperdodecane dioic acid. The content of bleaching agents in the detergents according to the invention is normally above 10% by weight, preferably between 15 to 35% by weight and more preferably between 20 and 30% by weight, based on the detergent as a whole.

In addition to the ingredients mentioned above, the detergents according to the invention may contain other detergent ingredients, for example from the group of bleach activators, enzymes, pH regulators, fragrances, perfume carriers, fluorescing agents, dyes, foam inhibitors, silicone oils, redeposition inhibitors, optical brighteners, discoloration inhibitors, dye transfer inhibitors and corrosion inhibitors.

In order to obtain an improved bleaching effect where washing is carried out at temperatures of 60° C. or lower, bleach activators may be incorporated in the detergents according to the invention. The bleach activators may be compounds which form aliphatic peroxocarboxylic acids containing preferably 1 to 10 carbon atoms and more preferably 2 to 4 carbon atoms and/or optionally substituted perbenzoic acid under perhydrolysis conditions. Substances bearing O- and/or N-acyl groups with the number of carbon atoms mentioned and/or optionally substituted benzoyl groups are suitable. Preferred bleach activators are polyacylated alkylenediamines, more particularly tetraacetyl ethylenediamine (TAED), acylated triazine derivatives, more particularly 1,5-diacetyl-2,4-dioxohexa-hydro-1,3,5-triazine (DADHT), acylated glycolurils, more particularly tetraacetyl glycoluril (TAGU), N-acylimides, more particularly N-nonanoyl succinimide (NOSI), acylated phenol sulfonates, more particularly n-nonanoyl or isononanoyloxybenzenesulfonate (n- or iso-NOBS), carboxylic anhydrides, more particularly phthalic anhydride, acylated polyhydric alcohols, more particularly triacetin, ethylene glycol diacetate and 2,5-diacetoxy-2,5-dihydrofuran.

In addition to or instead of the conventional bleach activators mentioned above, so-called bleach catalysts may also be incorporated in the detergents according to the invention. Bleach catalysts are bleach-boosting transition metal salts or transition metal complexes such as, for example, manganese-, iron-, cobalt-, ruthenium- or molybdenum-salen complexes or carbonyl complexes. Manganese, iron, cobalt, ruthenium, molybdenum, titanium, vanadium and copper complexes with nitrogen-containing tripod ligands and cobalt-, iron-, copper- and ruthenium-amine complexes may also be used as bleach catalysts.

The content of bleach activators or bleach catalysts in the detergents according to the invention may be between 1 and 15% by weight and is preferably between 2 and 12% by weight and more preferably between 5 and 10% by weight.

Suitable enzymes are those from the class of proteases, lipases, amylases, cellulases or mixtures thereof. Enzymes obtained from bacterial strains or fungi, such as Bacillus subtilis, Bacillus licheniformis and Streptomyces griseus, are particularly suitable. Proteases of the subtilisin type are preferred, proteases obtained from Bacillus lentus being particularly preferred. Enzyme mixtures, for example of protease and amylase or protease and lipase or protease and cellulase or of cellulase and lipase or of protease, amylase and lipase or of protease, lipase and cellulase, but especially cellulase-containing mixtures, are of particular interest. Peroxidases or oxidases have also proved to be suitable in some cases. The enzymes may be adsorbed to supports and/or encapsulated in shell-forming substances to protect them against premature decomposition. The percentage content of the enzymes, enzyme mixtures or enzyme granules in the detergents according to the invention may be, for example, from about 0.1 to 10% by weight and is preferably from 0.5 to about 5% by weight.

In addition, the detergents according to the invention may also contain components with a positive effect on the removability of oil and fats from textiles by washing (so-called soil repellents). This effect becomes particularly clear when a textile which has already been repeatedly washed with a detergent according to the invention containing this oil- and fat-dissolving component is soiled. Preferred oil- and fat-dissolving components include, for example, nonionic cellulose ethers, such as methyl cellulose and methyl hydroxypropyl cellulose containing 15 to 30% by weight of methoxyl groups and 1 to 15% by weight of hydroxypropoxyl groups, based on the nonionic cellulose ether, and the polymers of phthalic acid and/or terephthalic acid known from the prior art or derivatives thereof, more particularly polymers of ethylene terephthalates and/or polyethylene glycol terephthalates or anionically and/or nonionically modified derivatives thereof. Of these, the sulfonated derivatives of phthalic acid and terephthalic acid polymers are particularly preferred.

The non-aqueous detergents may contain derivatives of diaminostilbenzenedisulfonic acid or alkali metal salts thereof as optical brighteners. Suitable optical brighteners are, for example, salts of 4,4'-bis-(2-anilino-4-morpholino-1,3,5-triazinyl-6-amino)-stilbene-2,2'-disulfonic acid or compounds of similar composition which contain a diethanolamino group, a methylamino group, an anilino group or a 2-methoxyethylamino group instead of the morpholino group. Brighteners of the substituted diphenyl styryl type, for example alkali metal salts of 4,4'-bis-(2-sulfostyryl)-diphenyl, 4,4'-bis-(4-chloro-3-sulfostyryl)-diphenyl or 4-(4-chlorostyryl)4'-(2-sulfostyryl)-diphenyl, may also be present. Mixtures of the brighteners mentioned above may also be used.

Dyes and fragrances are added to the detergents according to the invention to improve the aesthetic impression created by the products and to provide the consumer not only with the required washing performance but also with a visually and sensorially "typical and unmistakable" product. Suitable perfume oils or fragrances include individual fragrance compounds, for example synthetic products of the ester, ether, aldehyde, ketone, alcohol and hydrocarbon type. Fragrance compounds of the ester type are, for example, benzyl acetate, phenoxyethyl isobutyrate, p-tert.butyl cyclohexyl acetate, linalyl acetate, dimethyl benzyl carbinyl acetate, phenyl ethyl acetate, linalyl benzoate, benzyl formate, ethyl methyl phenyl glycinate, allyl cyclohexyl propionate, styrallyl propionate and benzyl salicylate. The ethers include, for example, benzyl ethyl ether; the aldehydes include, for example, the linear alkanals containing 8 to 18 carbon atoms, citral, citronellal, citronellyloxyacetaldehyde, cyclamen aldehyde, hydroxycitronellal, lilial and bourgeonal; the ketones include, for example, the ionones, α-isomethyl ionone and methyl cedryl ketone; the alcohols include anethol, citronellol, eugenol, geraniol, linalool, phenyl ethyl alcohol and terpineol and the hydrocarbons include, above all, the terpenes, such as limonene and pinene. However, mixtures of various fragrances which together produce an attractive fragrance note are preferably used. Perfume oils such as these may also contain natural fragrance mixtures obtainable from vegetable sources, for example pine, citrus, jasmine, patchouli, rose or ylang-ylang oil. Also suitable are clary oil, camomile oil, nettle oil, melissa oil, mint oil, cinnamon leaf oil, lime blossom oil, juniper berry oil, vetiver oil, olibanum oil, galbanum oil and labdanum oil and orange blossom oil, neroli oil, orange peel oil and sandalwood oil.

The fragrances may be directly incorporated in the detergents according to the invention, although it can also be of advantage to apply the fragrances to supports which strengthen the adherence of the perfume to the washing and which provide the textiles with a long-lasting fragrance through a slower release of the perfume. Suitable support materials are, for example, cyclodextrins, the cyclodextrin/perfume complexes optionally being coated with other auxiliaries.

In order to improve their aesthetic impression, the detergents according to the invention may be colored with suitable dyes. Preferred dyes, which are not difficult for the expert to choose, have high stability in. storage, are not affected by the other ingredients of the detergents or by light and do not have any pronounced substantivity for textile fibers so as not to color them.

As already mentioned, the non-aqueous liquid detergents according to the invention may be adapted in their viscosity to meet the particular requirements of different applications. Thus, it is possible to formulate low-viscosity and readily pumpable detergents and also to produce more viscous to paste-form detergents which are known commercially as gels. Detergents which do not flow under the influence of gravity, i.e. cannot be poured and have a spreadable or cuttable consistency, can also readily be produced in accordance with the present invention. The viscosity of the detergents for a number of applications is normally in the range from 500 to 50,000 mPas, preferably in the range from 1,000 to 10,000 mPas and more preferably in the range from 3,000 to 5,000 mPas (T=70° C., shear rate 100 $s^{-1}$). For applications requiring a non-pourable consistency (for example detergent pastes for automatic dispensers in institutional dishwashing machines), a considerably higher viscosity may be appropriate, which can lead as far as dimensionally stable compounds that no longer have a viscosity in the above sense.

The detergents according to the invention are produced in known manner by mixing the ingredients in stirred tanks. If required for a given end product, the solids present in the detergents according to the invention can be further size-reduced by a wet grinding step in order further to increase the separation stability of the detergents. Operations such as these, which are familiar to the expert, may be carried out for example in colloid mills, roller mills or annular-gap or stirred ball mills.

The cationic stabilizers to be used in accordance with the invention may be added at any stage of such a routine production process. For example, the bleaching agent may be coated with the cationic stabilizers and the resulting coated particles of bleaching agent may be added to the other ingredients in a stirred tank which, of course, may again be followed by a grinding mill. The cationic stabilizers may also readily be added as a solid or paste-form pure substance or as a solution both before and after a grinding step. The bleaching agent and bleach activators are normally not incorporated in the detergent together before the grinding step because the intimate contact which the materials undergo during grinding can promote decomposition. If the bleach activators are added after a grinding step, the cationic stabilizers may be added in this stirring and homogenizing step. It is of course also possible to coat the bleach activators with the cationic stabilizers.

The present invention also relates to the use of cationic stabilizers corresponding to formula I, II or III:

(I)

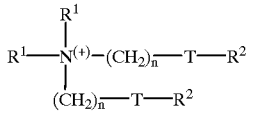

(II)

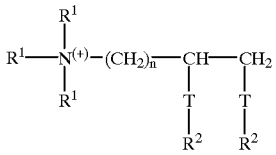

(III)

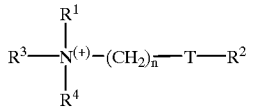

in which the groups $R^1$ independently of one another are each selected from $C_{1-6}$ alkyl, alkenyl or hydroxyalkyl groups, the groups $R^2$ independently of one another are each selected from $C_{8-28}$ alkyl or alkenyl groups, $R^3$ has the same meaning as $R^1$ or represents $(CH_2)_n$—T—$R^2$, $R^4$ has the same meaning as $R^1$ or $R^2$ or represents $(CH_2)_n$—T—$R^2$, T represents —$CH_2$—, —O—CO— or —CO—O— and n is an integer of 0 to 5, for stabilizing bleaching agents in non-aqueous detergents. The use of the compounds mentioned leads to liquid detergents which show increased stability of the bleaching agent and which retain this property over long periods of storage.

EXAMPLES

Isothermal microcalorimetry has proved to be a particularly suitable method for rapidly evaluating the decomposition stability of liquid products. In this test method, the heat effect of the generally exothermic decomposition reaction is very sensitively detected, even in small sample quantities. In general, the stability of a given system to decomposition is higher, the smaller the quantity of heat in joules produced in a given time.

A TAM 2277 isothermal microcalorimeter (manufacturer: Thermometric AB, Sweden) was used for the present investigations. This instrument continuously determines the amount of heat generated by a sample per unit of time in watts.

In order to determine the integral amount of heat, quantities of 1 g of a liquid detergent were hermetically sealed in a 4 ml glass ampoule and the heat effect of this sample was followed in the microcalorimeter for several days at a temperature of 40° C. For evaluation, the heat generated was integrated over the test period (120 h).

The liquid detergent E according to the invention investigated contained a cationic stabilizer whereas Comparison Example C was free from the stabilizers used in accordance with the invention. Small quantities of water and Fe(III) ions were added to both formulations to simulate realistic conditions (contamination by production units etc.). The composition of the liquid detergents is shown in Table 1.

TABLE 1

Composition of the liquid detergents (parts by weight)

| | E | C |
|---|---|---|
| $C_{12-18}$ fatty alcohol.7 EO | 50.0 | 50.0 |
| Sodium perborate monohydrate | 20.0. | 20.0 |
| 3,5-Ditert.butyl-4-hydroxytoluene | 0.1 | 0.1 |
| Hydroxyethane-1,1-diphosphonic acid | 0.6 | 0.6 |
| Trisodium citrate | 10.0 | 10.0 |
| $C_{12-18}$ fatty acid, Na salt | 0.2 | 0.2 |
| Tetraacetyl ethylenediamine | 6.0 | 6.0 |
| Stepantex ® VA 90* | 2.0 | — |
| Water | 1.0 | 1.0 |
| $Fe^{3+}$ | 10 ppm | 10 ppm |

*Ditallow acyloxyethyl hydroxyethyl methyl ammonium methoxysulfate, 90% in isopropanol, a product of Stepan Borth formulations were investigated in the microcalorimeter for 120 hours as described above. The amount of heat generated over the total test period was obtained by integration, in addition to which the momentary amounts of heat $P_{80}$, $P_{100}$ and $P_{120}$ were determined after 80, 100 and 120 hours. The results are shown in Table 2:

TABLE 2

Momentary and integral quantities of heat [$\mu$ W, J]

| Formulation | Integral quantity of heat over 120 hours [J] | $P_{80}$ [$\mu$ W] | $P_{100}$ $\mu$ W] | $P_{120}$ [$\mu$ W] |
|---|---|---|---|---|
| C | 32 | 68 | 72 | 78 |
| E | 30 | 58 | 52 | 47 |

A smaller integral quantity of heat is found in formulation E according to the invention than in comparison formulation C. In addition, the momentary generation of heat continues to decrease in the case of formulation E, but continues to increase in the case of formulation C. This is proof of the higher stability of formulation E according to the invention compared with formulation C.

What is claimed is:

1. A non-aqueous liquid detergent comprising:

(a) 5 to 70 percent by weight of a nonionic surfactant;

(b) 1 to 30 percent by weight of a builder;

(c) at least 10 percent by weight of a bleaching agent; and (d) 0.5 to 10 percent by weight of a cationic stabilizer corresponding to formula I, II or III:

(I)

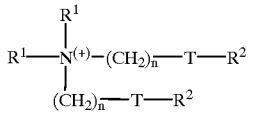

(II)

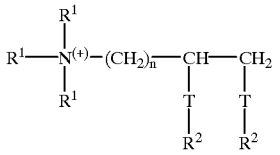

(III)

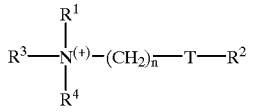

wherein the groups $R^1$ independently of one another are $C_{1-6}$ alkyl, alkenyl or hydroxyalkyl groups, the groups $R^2$ independently of one another are $C_{8-28}$ alkyl or alkenyl groups, $R^3$ has the same meaning as $R^1$ or represents $(CH_2)_n$—T—$R^2$, $R^4$ has the same meaning as $R^1$ or $R^2$ or represents $(CH_2)_n$—T—$R^2$, T represents, —O—CO— or —CO—O— and n is an integer of from 0 to 5.

2. The non-aqueous liquid detergent of claim 1 comprising 1 to 6 percent by weight of the cationic stabilizer.

3. The non-aqueous liquid detergent of claim 1 comprising 2 to 4 percent by weight of the cationic stabilizer.

4. The non-aqueous liquid detergent of claim 1 wherein the cationic stabilizer comprises a quaternary triethanolamine ester.

5. The non-aqueous liquid detergent of claim 1, wherein the cationic stabilizer comprises the compound of formula I, wherein the groups $R^1$ independently of one another are methyl, ethyl or 2-hydroxyethyl groups, the groups $R^2$ independently of one another are $C_{8-28}$ alkyl or alkenyl groups, T═O—CO— and n is 1, 2 or 3.

6. The non-aqueous liquid detergent of claim 5 wherein the groups $R^2$ independently of one another are $C_{10-20}$ alkyl or alkenyl groups.

7. The non-aqueous liquid detergent of claim 6 wherein the groups $R^2$ independently of one another are $C_{12-18}$ alkyl or alkenyl groups.

8. The non-aqueous liquid detergent of claim 1 comprising 15 to 65 percent by weight of nonionic surfactant.

9. The non-aqueous liquid detergent of claim 8 comprising 20 to 60 percent by weight of nonionic surfactant.

10. The non-aqueous liquid detergent of claim 1 wherein the nonionic surfactant comprises an alkoxylated alcohol or an alkoxylated carboxylic acid containing 8 to 28 carbon atoms or mixtures thereof.

11. The non-aqueous liquid detergent of claim 10 wherein the alkoxylated alcohol or alkoxylated carboxylic acid is ethoxylated or ethoxylated and propoxylated.

12. The non-aqueous liquid detergent of claim 10 wherein the nonionic surfactant comprises an alkoxylated alcohol or an alkoxylated carboxylic acid containing 10 to 20 carbon atoms or mixtures thereof.

13. The non-aqueous liquid detergent of claim 12 wherein the nonionic surfactant comprises an alkoxylated alcohol or an alkoxylated carboxylic acid containing 12 to 18 carbon atoms or mixtures thereof.

14. The non-aqueous liquid detergent of claim 1 further comprising an anionic surfactant.

15. The non-aqueous liquid detergent of claim 14 wherein the anionic surfactant comprises an alkyl sulfate, an alkyl sulfonate, an alkyl benzenesulfonate or a fatty acid soap.

16. The non-aqueous liquid detergent of claim 1 wherein the builder is selected from the group consisting of oligo- and polycarboxylates, carbonates and crystalline or amorphous silicates.

17. The non-aqueous liquid detergent of claim 1 comprising 10 to 25 percent by weight of builder.

18. The non-aqueous liquid detergent of claim 1 comprising:

(a) 15 to 65 percent by weight of said nonionic surfactant;

(b) 1 to 30 percent by weight of said builder;

(c) 15 to 35 percent by weight of said bleaching agent; and (d) 1 to 6 percent by weight of said cationic stabilizer.

19. The non-aqueous liquid detergent of claim 18 comprising:

(a) 20 to 60 percent by weight of said nonionic surfactant;

(b) 10 to 25 percent by weight of said builder;

(c) 20 to 30 percent by weight of said bleaching agent; and (d) 2 to 4 percent by weight of said cationic stabilizer.

* * * * *